US007621304B2

(12) United States Patent
Nielsen

(10) Patent No.: US 7,621,304 B2
(45) **Date of Patent: *Nov. 24, 2009**

(54) CLOSEABLE SELF-VENTING SPOUT

(75) Inventor: Roger B. Nielsen, Meridian, ID (US)

(73) Assignee: Nielsen Idaho Tool & Engineering Corporation, Meridian, ID (US)

( * ) Notice: Subject to any disclaimer, the term of this patent is extended or adjusted under 35 U.S.C. 154(b) by 28 days.

This patent is subject to a terminal disclaimer.

(21) Appl. No.: 11/745,445

(22) Filed: May 7, 2007

(65) Prior Publication Data

US 2008/0035240 A1 Feb. 14, 2008

Related U.S. Application Data

(60) Provisional application No. 60/798,148, filed on May 5, 2006.

(51) Int. Cl.
*B65B 3/04* (2006.01)
*B65B 39/04* (2006.01)

(52) U.S. Cl. ..... 141/351; 141/301; 141/309; 141/321; 222/566

(58) Field of Classification Search ..... 141/285, 141/309, 311 A, 311 R, 319–322, 351, 353–356, 141/387–388, 392, 301; 222/479, 566–570
See application file for complete search history.

(56) References Cited

U.S. PATENT DOCUMENTS 2,963,205 A 12/1960 Beall, Jr.
3,606,096 A 9/1971 Campbell
4,105,148 A 8/1978 Williams
4,598,743 A 7/1986 Milling
4,667,710 A 5/1987 Wu
4,802,610 A 2/1989 Cheek et al.
4,834,151 A 5/1989 Law
5,076,333 A 12/1991 Law
5,107,909 A 4/1992 Donovan
5,249,611 A 10/1993 Law
5,507,328 A 4/1996 Donovan
5,628,352 A 5/1997 Gracyalny et al.

(Continued)

*Primary Examiner*—Timothy L Maust
*Assistant Examiner*—Nicolas A Arnett
(74) *Attorney, Agent, or Firm*—Pedersen & Co., PLLC; Ken J. Pedersen; Barbara S. Pedersen

(57) ABSTRACT

A non-spilling, detachable pouring spout is configured to transfer liquid from a non-vented filling container to a receiving container. The spout has a spout body defining a first hollow passageway extending from an open first end to an open second end, wherein this open passageway having a generally tubular hollow inner conduit positioned within the first hollow passageway and defining a second hollow passageway. An intermediate sleeve is received in the spout and seals against portions of the spout body and the inner conduit so as to variously control the flow of materials out of the spout body, preferably the flow of liquid out of the spout and air into the spout as a venting system. The movement of said sleeve may be controlled by movement of an external sheath and may include child-resistant features. The preferred spout may achieve smooth air venting and liquid flow, and minimizes transverse/sideways flow and openings that tend to cause splash and leaks. The preferred spout does not use any O-ring members, which are prone to failure when used with gasoline, but instead uses a slidable sleeve with inner and outer seal surfaces provided by a flared or bell-shaped seal member.

32 Claims, 14 Drawing Sheets

U.S. PATENT DOCUMENTS

| | | | | |
|---|---|---|---|---|
| 5,641,099 | A | 6/1997 | McLelland et al. | |
| 5,704,408 | A * | 1/1998 | Law | 141/352 |
| 5,762,117 | A | 6/1998 | Law | |
| 5,988,458 | A * | 11/1999 | Messner | 222/478 |
| 6,155,464 | A | 12/2000 | Vachon | |
| 6,186,375 | B1 | 2/2001 | Chrisco et al. | |
| 6,227,419 | B1 | 5/2001 | Raboin | |
| 6,397,902 | B1 | 6/2002 | Murphy | |
| 6,435,380 | B1 | 8/2002 | Raboin | |
| 6,478,058 | B1 | 11/2002 | Pears | 141/353 |
| 6,484,765 | B1 * | 11/2002 | Clemmons et al. | 141/352 |
| 6,581,851 | B1 * | 6/2003 | Murphy | 141/285 |
| 6,598,630 | B1 * | 7/2003 | Trippi, Jr. | 141/350 |
| 6,871,680 | B2 | 3/2005 | Trippi, Jr. | 141/350 |
| 6,889,732 | B2 | 5/2005 | Allen | 141/353 |
| 6,968,875 | B2 | 11/2005 | Nielsen | 141/351 |
| 7,013,936 | B2 * | 3/2006 | Schliemann et al. | 141/353 |
| 7,089,975 | B2 * | 8/2006 | Chrisco et al. | 141/286 |
| 7,128,108 | B2 | 10/2006 | Nielsen | 141/351 |
| 2002/0074365 | A1 | 6/2002 | Young | |
| 2002/0074366 | A1 | 6/2002 | Young | |
| 2003/0034363 | A1 | 2/2003 | Morgenroth | |
| 2003/0066850 | A1 | 4/2003 | Young | |

* cited by examiner

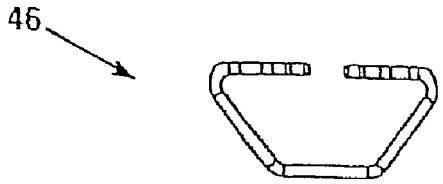
FIG. 7 A
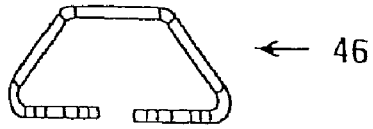
FIG. 7 B
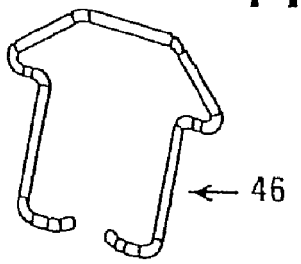
FIG. 7 C
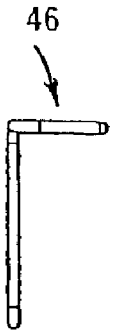
FIG. 7 D
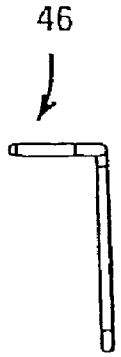
FIG. 7 F
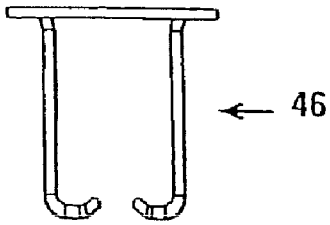
FIG. 7 E
FIG. 7

10
248
250
200

250
200
248
270

246
248
270
200

250
248
270
200

200

200

10

228
238

266
228

D
D
C
C 266
228

228

236

236
238

228
246
247

246
247
247'

246
247
247'

247'
247

247'
247

250

250

250

250
H
I

250

250

B
B
250

250

H
I

250

250

250

250

250

250

250

250

272

273

F
F
272
273

272

273
272

272

CLOSEABLE SELF-VENTING SPOUT

This application claims priority of Provisional Application Ser. No. 60/798,148, filed May 5, 2006, and entitled "Closeable Self-Venting Spout," which is hereby incorporated by reference.

BACKGROUND OF THE INVENTION

1. Field of the Invention

The present invention generally relates to pouring spouts that are configured to transfer the contents of a storage or transfer container to a receiving container. More particularly, the present invention relates to a self-venting pouring spout that can be selectively opened and closed, and, preferably, may be automatically opened upon insertion into the opening of the receiving container. The preferred embodiment is a selectively-openable, self-venting, child-resistant spout that provides smooth transfer of liquid materials from a non-vented filling container to a receiving container. The preferred embodiment minimizes or eliminates leaks and sideways flow and splash, and minimizes or eliminates the use of O-rings in the construction of the spout.

2. Background Information

Many products are stored in one container, but must be transferred to another container for use. An example of such a product is gasoline, which may be stored in a variety of differently-configured containers, but, in order to be used, is transferred to a refillable holding tank that is connected to an internal combustion engine. For instance, a typical homeowner who owns a lawnmower, snow blower, or other such device that is powered by a small gasoline engine would typically have a storage container filled with gasoline. In order to use any of these gasoline-powered devices, gasoline must be transferred from the storage container into the holding tank of the engine, which is located upon the device.

In the process of pouring gasoline or other material from one container into another, a variety of problems arise. One problem is that the size of the opening in the filling container may not be compatible with the size of the opening on the receiving container. As a result, the material being transferred may splash or flow over the outer portions of the container being filled. When this occurs, the spilled material is not only wasted but may also be toxic or otherwise dangerous or damaging to persons or things in the surrounding area. For example, spilled gasoline raises a variety of concerns of safety to both the environment and the individual. Spilled liquid gasoline may damage the surrounding environment, including soil, plants, and water, and the spilled gasoline also emits fumes that can be hazardous due to inhalation and increased risk of flammability.

In order to limit these effects, a variety of spouts and nozzles have been developed. However, these nozzles and spouts bring with them a variety of problems as well. One of the problems with many of these types of nozzles is their inability to allow for a smooth transfer of air into the filling container to replace the liquid that is leaving the container, thus forming a vacuum within the filling container. This vacuum restrains the liquid from exiting the filling container. When sufficient pressure is built up, however, the vacuum is broken and liquid will surge forward out of the filling container. The repetitive surging of air into, and the surging exit of liquid out of, the nozzle and filling container typically cause what may be called "chugging" or "gurgling" of the liquid. This chugging or gurgling makes difficult the filling of a receiving container to a desired level without spilling, because the quantity of material that will surge forward is unpredictable. Thus, this uneven liquid flow contributes to spillage and/or over filling of the container.

Another problem that exists in the prior art is that access to these filling containers may be obtained by small children, who may inhale the fumes or ingest the gasoline and suffer significant damaging effects.

Another problem that exists in the prior art is the use of O-rings as sealing systems, and, typically, the use of O-rings on moving valve elements. O-rings seal by simply overpowering the material that they are sealing against, and, as a result, O-rings place substantial static pressures upon, and may cause failure of, various pieces of the spout. Over time, the O-rings themselves, especially those provided on moving elements, may wear out or be degraded by the chemicals that they are trying to seal. As a result, replacements are needed in order to provide the proper and adequate sealing properties. Another problem with such devices is that they can be prohibitively expensive to manufacture and produce.

Therefore, what is needed is a pouring spout that can be selectively opened to allow the free, smooth flow of liquid from a filling container into a receiving container, and that can be selectively closed and sealed to prevent leakage, preferably with few or no O-ring seals. What is also needed is a spout that is detachable and storable in the filling container. What is also needed is a spout that provides the aforementioned features and also comprises a child-resistant locking device that remains consumer friendly and usable by adults of varied physical capabilities.

Other objects, advantages and novel features of the preferred embodiments will be set forth in part in the description which follows and in part will become apparent to those skilled in the art upon examination of the following or may be learned by practice of the invention.

SUMMARY OF THE INVENTION

An object of the present invention is to provide a spout that allows for regular flow of material through a valve system, formed within a portion of the spout, which provides for decreased leaks and spills. A preferred feature is to provide a closable spout of sufficient length and shape to give free access between the opening in the receiving tank and the filling tank, while being adapted for detachment, inversion, and insertion inside the filling container, for example, for storage and shipping inside a typical gas-can type filling container. Another preferred feature is to provide a sealing system in the spout that does not utilize an O-ring, and especially that does not utilize an O-ring installed on, or sealing with, a sliding element, as such O-rings have been known to swell and fail from contact with gasoline. A further object of the preferred embodiments is to provide a spout adapted to easily release excessive container pressure prior to use.

The self-venting spout comprises a valve system wherein the sliding of an internal valve sleeve, in one direction, seals closed both a liquid passageway and an air passageway, and, in the opposite direction, opens both of said liquid and air passageways. The valve sleeve may be actuated by an external actuation member such as a sheath, which is operatively linked to the valve sleeve by a wire, clip, or other connecting member extending from the sheath through the spout body and into the spout interior to reach the sleeve. Preferably, the liquid and air passageway openings at the dispensing end of the spout are entirely or substantially longitudinal (parallel to the length of the spout) rather that transverse, which minimizes or prevents the splash and leaking typically associated with "sideways" flow out of a filling spout. Further, the preferred valve sleeve and its actuation system are adapted so that there is some leeway in the actuation structure to prevent leaking of the spout due to manufacturing tolerances, and/or upon a small movement, impact, or jiggling of the actuation member. This may be accomplished, for example, by providing a physical gap in the actuation system, so that some movement of the actuation member and/or the connecting member may occur without the valve sleeve becoming dislodged from its liquid and air passageway sealing position. This way, an intentional effort, rather than a tap or bounce, is needed to unseal the valve so that leaking is minimized or eliminated during transport and handling of the device.

The preferred spout comprises a spout housing with an interior spout surface generally surrounding an interior passageway extending between opposing open ends of the spout, an outer sealing surface in said interior passageway at or near the interior spout surface, an inner sealing surface generally centered in said interior passageway and radially distanced from said interior spout surface and from said outer sealing surface, a slidable sleeve in said interior passageway comprising an outer sleeve surface with a first generally annular seal and an inner sleeve surface defining a sleeve passageway and having a second generally annular seal.

When the slidable sleeve is in a spout-closed position, the first generally annular seal contacts and seals against the outer sealing surface, and the second generally annular seal contacts and seals against the inner sealing surface. Further, the spout comprises partition wall(s) or members dividing the interior passageway into an air-flow passageway portion and a liquid-flow passageway portion, and wherein, when the slidable sleeve is in the spout-closed position, the sealing of the first generally annular sleeve and the outer sealing surface blocks said liquid-flow passageway portion and said sealing of the second generally annular seal and the inner sealing surface blocks said air-flow passageway portion. When the slidable sleeve is slid longitudinally to the spout-open position, the first generally annular seal is distanced from the outer sealing surface to open said liquid-flow passageway portion and the second generally annular seal is distanced from the inner sealing surface to open said air-flow passageway portion.

The spout may further comprise an outer member such as a sheath that is slidable on the spout housing to actuate the valve system and a clip that extends from near said outer sheath and through said spout housing to engage the slidable sleeve. The outer sheath may be configured to engage the clip so that sliding said outer sheath longitudinally on the spout housing pulls the clip longitudinally to move the slidable sleeve from said spout-closed position to said spout-open position. This way, during insertion of the spout into an opening in a receiving container, the outer sheath may abut against the receiving container neck or other opening, and, upon further insertion, the outer sheath will be pushed longitudinally, thus actuating the valve system to the spout-open position. A spring or other biasing member may be used to bias the slidable sleeve into the spout-closed position.

The spout housing may comprise a nozzle unit generally coaxially connected to the housing body, wherein the nozzle unit provides the outer sealing surface and the inner sealing surface, which in many embodiments may be called a sealing ridge and a stopper, respectively. The slidable sleeve may have at least one longitudinal projection extending toward the liquid-outlet end of the spout. The nozzle unit may be generally hollow and receive the longitudinal projection, wherein the nozzle unit may have at least one alignment protrusion extending radially inward toward, and engaging, said longitudinal projection. The connecting member or "clip" may connect to said at least one longitudinal projection for moving the slidable sleeve.

The preferred liquid-flow passageway portion may comprise a proximal portion near the liquid-inlet end of the spout housing and a distal portion near the liquid-outlet end of the spout housing. Preferably, the distal portion is smaller in volume than the proximal portion for creating a venturi effect as the liquid flows through said liquid-flow passageway portion toward the liquid-outlet end.

The preferred air-flow passageway portion is defined near said spout housing liquid-inlet end by a generally tubular extension out from the spout housing that is configured to extend into the liquid filling container farther than the end of the spout housing so that the pressure in the generally tubular extension is less than the pressure in the liquid-flow passageway portion at that end of the spout housing.

The preferred self-venting spout may be alternatively described as comprising an elongated spout housing having an interior volume comprising an interior liquid-flow passageway and an interior air-flow passageway both extending between a first end of the spout housing (for connection to a filling container to receive liquid from the filling container) and a second end of the spout housing (for dispensing the liquid to another container). The air-flow passageway is preferably generally centered on a longitudinal axis of the spout housing and said liquid-flow passageway radially offset from said air-flow passageway, that is, closer to the housing wall. A stopper or other sealing member is disposed in the air-flow passageway, and a sealing ridge or other sealing member is disposed in the liquid-flow passageway. A valve sleeve is slidably disposed in said interior volume and has an exterior surface defining a portion of said liquid-flow passageway and an interior surface defining a portion of said air-flow passageway. The sleeve further has a preferably-protruding first seal on its exterior surface and a preferably-protruding second seal on its interior surface, so that, when said sleeve is slid longitudinally to a closed-spout position, said first seal contacts and seals with the sealing ridge to seal closed the liquid-flow passageway to stop liquid flow, and also said second seal contacts and seals to said stopper to seal closed the air-flow passageway to stop air flow. When said sleeve is slid longitudinally to an open-spout position, the first seal and second seal are distanced from said sealing ridge and said stopper, to allow liquid to flow through the liquid-flow passageway past said first seal to said second end, and to allow air to flow through the air-flow passageway past said second seal to the first end, respectively.

The invention may also comprise a system which comprises the combination of a liquid container and a spout. The spout may be described as having a first end connected to the liquid container, a second end adapted for dispensing liquid from the spout, and an internal passageway from said first end to said second end having a liquid-flow passage and an air-flow passage. The spout may further comprising a slidable sleeve inside the spout and configured to slide to a spout-closed position wherein the slidable sleeves seals the liquid-flow passage closed and slidable in an opposite direction to a spout-open position wherein liquid-flow passage is open for dispensing of liquid. The slidable sleeve may be operatively connected to a movable member on an outside surface of said spout that moves said slidable sleeve inside the spout between said spout-closed and spout-open positions. The slidable sleeve may seal the air-flow passage closed when said slidable sleeve is in the spout-closed position, but the air-flow passage is open for venting of the liquid container when said slidable sleeve is in the spout-open position. The preferred liquid passageways and the operative connection between the moveable member and the slidable sleeve are adapted to minimize or eliminate transverse liquid flow and openings/apertures through the spout housing and especially the half of the spout that is typically orientated at the bottom when the spout is in use filling the receiving container. This lack of openings/apertures in the "bottom" half of the spout prevents leakage/seepage that might otherwise occur if such openings/apertures were present.

Still other objects, advantages, and features of the present invention will become apparent to those skilled in this art by viewing the following detailed description and drawings of preferred embodiments and best modes of the invention. The description and drawings of the preferred embodiments and modes are to be regarded as illustrative in nature, and not as restrictive in nature.

BRIEF DESCRIPTION OF THE DRAWINGS

FIGS. 7A-7F are views, from a variety of perspectives, of one embodiment of the sliding clip of the embodiment of FIGS. 1-3.

DESCRIPTION OF THE PREFERRED EMBODIMENTS

Figure 1:
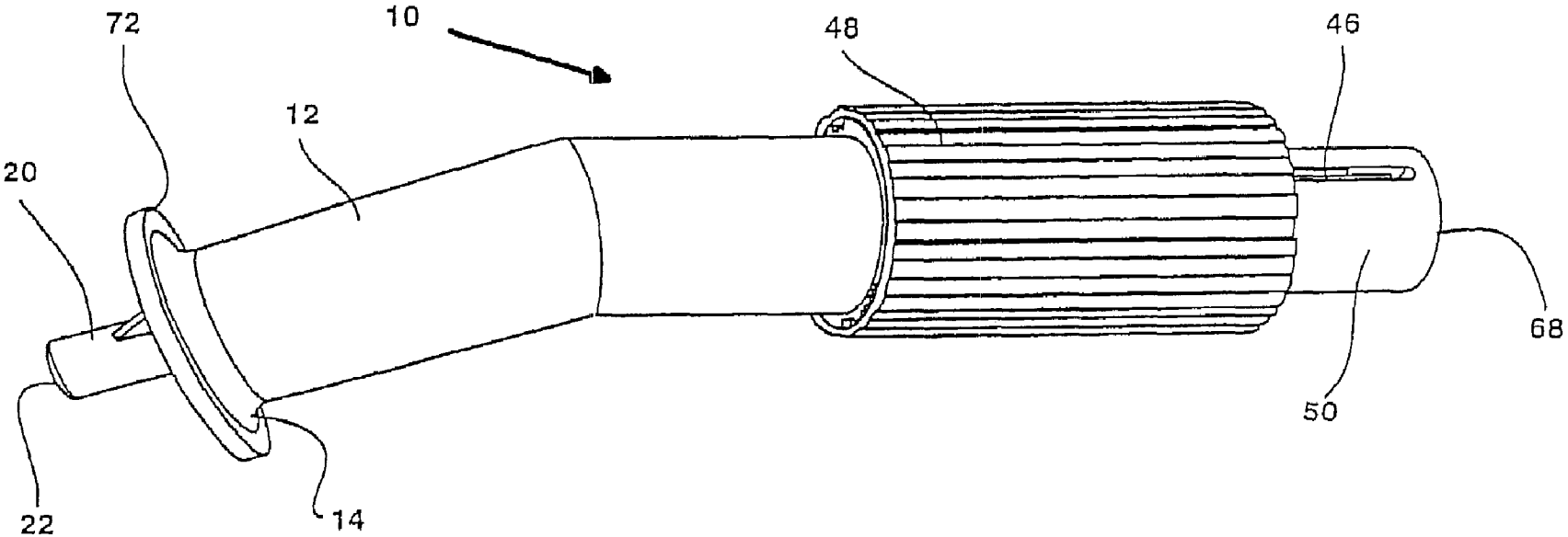
FIG. 1 is a side view of one embodiment of the present invention.

While embodiments of the invention may be modified and alternatively constructed, certain embodiments have been shown in the drawings and will be described below in detail. It should be understood, however, that there is no intention to limit the invention to the specific forms disclosed, as the invention is to cover all modifications, alternative constructions, and equivalents falling within the spirit and scope of the invention as defined in the claims.

The preferred self-venting pouring spout is especially-well adapted for a non-vented filling container. The spout housing may be made of one or more pieces/units, but in the embodiments shown, the housing comprises a single one-piece tube as a spout body, and a nozzle unit or "nozzle end". The spout body comprises a first hollow passageway with an open spout first end and an open spout second end, wherein the spout body connects at its second end to the nozzle unit.

A generally hollow tubular inner conduit is formed, by one or more walls, tubes or wall or tube portions, within the first hollow passageway. The inner conduit defines a second hollow passageway in the spout, to act as an air vent tube, having an inner conduit first end positioned near the spout body first end and an inner conduit second end positioned near the spout body second end. The inner conduit at or near its second end is configured to receive a biasing spring and a portion of a slidable or "intermediate" sleeve. The generally hollow intermediate sleeve defines a third hollow passageway.

The slidable intermediate sleeve first end is configured to be slidably inserted within, or to otherwise slidably and operatively cooperate with, the inner conduit. The slidable intermediate sleeve second end is configured to be slidably positioned within, or to otherwise slidably and operatively cooperate with, a portion of the nozzle unit. The intermediate sleeve further comprises seal members on both its outside and its inside, which preferably take the form of a generally circular flared portion, for example, a bell-shaped or campanulate portion. The campanulate portion is configured to form a sealing connection with a compatibly-configured portion of the spout housing, wherein, in the preferred embodiments, said compatibly-configured portion of the spout housing is a portion of the nozzle unit.

The nozzle unit or "nozzle end" of the spout has a body, an open nozzle first end configured to connect with the spout body second end, and an open nozzle second end configured for placement within a receiving container. The open nozzle second end further comprises a generally crescent-shaped partition. The generally crescent-shaped partition runs along the length of the nozzle unit and is configured to define an airflow chamber and a liquid flow chamber within the nozzle unit. The partition further comprises a "stopper" seal member configured to interact with the inner seal of the slidable intermediate sleeve, preferably by sealing against an inner surface of the flared or campanulate-shaped member so as to prevent the passage of air through the nozzle.

The intermediate sleeve is configured to slide within the spout housing, that is, in the preferred embodiments, within the spout body and the nozzle unit. Depending upon the position of the intermediate sleeve, the flow of material out of the device may be controlled between a fully-closed position, wherein no fluid may pass out of the spout/nozzle end, and a fully-opened position, wherein the flow of fluid from the filling container out through the spout/nozzle end and the flow of air in the opposite direction into the spout/nozzle end and into the container are maximized.

The intermediate sleeve is also operatively connected to, or otherwise engagable by, a sliding clip and sheath system that is configured to move the sliding sleeve into the open and closed positions and a continuum of positions in between. The sheath acts as the exterior "handle" for actuating the clip and sleeve valve mechanism. Optionally, the sheath and clip system may be configured to be child-resistant, preferably with the sheath interacting with portions of the outer surface of the spout body to prevent the sheath and/or clip from moving unless the outer sheath is twisted/rotated in a desired orientation. This configuration prevents the opening of the spout by persons such as small children, who lack the ability or comprehension to twist and slide the outer sheath in order to open the spout.

In use, the spout is connected and sealed to an outlet portion of a non-vented filling container, and a portion of the inner conduit extending into the non-vented filling container to a position adequate to control relief of a vacuum as it forms. The biasing system of the spout keeps the spout closed during installation of the spout on the filling container and during handling of the container-spout combination.

When the outer sheath is moved in a direction toward the storage container, the sliding clip engages extension portions of the inner sleeve and pushes the inner sleeve back against the biasing member. When the biasing member is sufficiently compressed, channels between the previously-sealed members open to open up the liquid and air passageways, so that liquid and air may flow through the spout in their respective directions. The walls, extensions, and projections of the nozzle unit and the intermediate sleeve interact to form a telescoping partition that maintains an airflow channel and a liquid flow channel substantially separate from each other. Additionally, when utilizing the device for the first time, the action of opening the valve vents the nozzle and allows built up vapors and gasses to be dissipated.

As the intermediate sleeve is progressively moved backward toward the filling container, the size of the channels for the flow of air into the filling container as well as the flow of liquid out of the spout are progressively increased. As a result, the exchange of air into the filling container and flow of liquid out of the filling container is accomplished in a smooth manner without the gurgling and surging problems that are associated with prior art spouts.

This venting system, as incorporated in the new spout, bypasses the problems of the vent system function found in the prior art. In the present invention, the combination of an air vent passageway and a liquid flow passageway that are substantially separated from each other allows the fluids that are positioned within the container to exit downward through the spout and to flow smoothly without surging, chugging, or gurgling as may occur in prior art embodiments.

The preferred embodiments are configured so that the air vent "tube"/passageway is positioned so as to allow the passage of air through the air vent passageway up into the container to replace the liquid that passes out of the filling container through the liquid flow passageway. The liquid flow passageway is configured to receive a greater volume of material than the air flow passageway. The liquid flow passageway is also configured to be positioned lower (closer to the floor/ground) than the open end of the air vent tube when the filling container is inverted into a vertical position. This configuration utilizes the force of gravity to pull liquid down through the spout, so that, with the spout inserted into the receiving container, the filling container inverted and the valve slid into an open position, the force of gravity pulls the liquid downward through the liquid flow passageway of the spout and into the receiving container. As this liquid enters into the receiving container, the air is displaced from the receiving container (or from the surroundings) and passes upward into the airflow passageway of the spout, which is separate from the liquid flow passageway, up and into the filling container.

During use (with the filling container inverted), the top end/opening of the airflow passageway within the filling container is vertically higher than the position of the liquid flow passageway within the same filling container. As a result, the liquid that is closest to the liquid flow passageway exits the filling container first, and the air is enabled to flow through the airflow passageway up and into the filling container at a location that is past the level of equalization between the liquid and the air. Because the air vents higher into the inverted filling container than the draining position from whence the liquid flows, the air and the liquid do not significantly interface nor do they block the flow of one another. As a result, so-called "pressure plugs" do not form and the flow of material into and out of the filling container and its spout is smooth.

The smoothness of the flow of air into, and of the flow of liquid out of, the filling container is further enhanced by sequentially reducing the dimensions of the liquid flow passageway, as the liquid passageway extends away from the filling container. In other words, the fluid flow passageways are larger in diameter and volume nearest the first end of the spout (near the filling container) and decrease in size to a smaller diameter and volume further along the length of the spout body toward the second end of the spout (near receiving container), while the dimensions of the airflow passageway are preferably increased as the airflow passageway extends away from the filling container. This configuration ensures that an air bubble will exist at a location in the vent tube that is higher than liquid that is positioned in the full diameter of the fluid in the liquid flow chamber. This volumetric change (reduction) near the second (outlet) end concentrates the gravitational pressure upon the fluid column at the joint or elbow of the device and allows the internal air bubble to rise above the fluid level. This variation in size slows the rate at which liquid will exit the device and allows the rate at which air enters the filling device to be greater than the rate at which liquid leaves this same container. As a result, sufficient air to replace exiting liquid is always present and the problems of chugging and surging, which exist in the prior art, are done away with.

The cooperating sliding sleeve and nozzle unit allow for the air flow and the liquid flow chambers to be effectively telescoped in length, as the valve system is moved between an open and a closed position, thus allowing the venting system and the liquid flow chambers to be maintained separately and preventing the problems of vacuum formation, surging, and chugging which are found in the prior art.

When the sliding sleeve opens the channels/passageways, a venturi effect caused by the passing flow of the exiting fluid flow is created and the air and fluid are prevented from mixing. The combination of these features delivers unimpeded air to the vent tube near the filling container neck and does away with the gurgling, surging and splashing that are found in the prior art.

When the spout is first placed the filling container and the container is inverted, liquid will tend to fill both the airflow and liquid flow passageways. However, when the spout is opened, the venturi effect, which is brought about by the variations in the dimensions of the spout, causes the liquid that is within the air flow passageway to rapidly evacuate from the air flow passageway and to be rapidly replaced with air. Once the flow of air through the airflow passageway has been established, the physical structure of the spout maintains the separation between the flow of air and liquid in opposite directions through the spout. Any erratic fluid behaviors can be controlled internally and does not expose consumers or equipment to wayward sprays or gurgles.

The preferred embodiments also provide a significant advantage in that they eliminate the use of O-rings to seal the spout, thus reducing manufacturing costs and the number of seal failures. The shape of many of the spout elements are self-nesting and self-sealing, thus reducing manufacturing costs and eliminating O-rings, which are a weak point in prior art designs. This venting system is fully internally self-contained.

The preferred embodiment of FIGS. 1-8B has a child-resistant flange connected to the outer sheath. In the valve-closed position, the slide is free from any demanding contacts. When valve-opening is desired, spring features are engaged to act on the slide in both a radial and linear manner. Turning the sheath will disengage the child resistant feature allowing the slide to be pulled back in a linear direction down the length of the spout. With a slight delay, as the movement passes the child resistant feature, the internal face of the sheath flange engages the slide clip, which pushes back the sliding sleeve. This valve-opening action can be accomplished either entirely by the user grasping and manipulating the sheath, or by the user twisting the sheath to a hold position, inverting the container, and pushing the "face" of the sheath against the lip/neck of the receiving container, which would then push back the sheath to open the spout.

The design of the second end of the spout is self-evacuating upon valve closure. After the receiving container has reached capacity, lifting the filling container allows the internal biasing spring to act on the sliding sleeve to return the spout to its closed and safe position. The face of the outer sheath will remain in contact with the lip/neck of the receiving container until the valve seals, at which time contact between the receiving container and the outer sheath will be broken as the spout continues to be lifted out of the receiving container. The tip (outermost extremity) of the spout will break the fluid surface level of the receiving container and instantly self-evacuate because the vent tube channel is filled with air and is exposed to the top of the remaining fluid inside the nozzle end of the spout.

Figure 2:
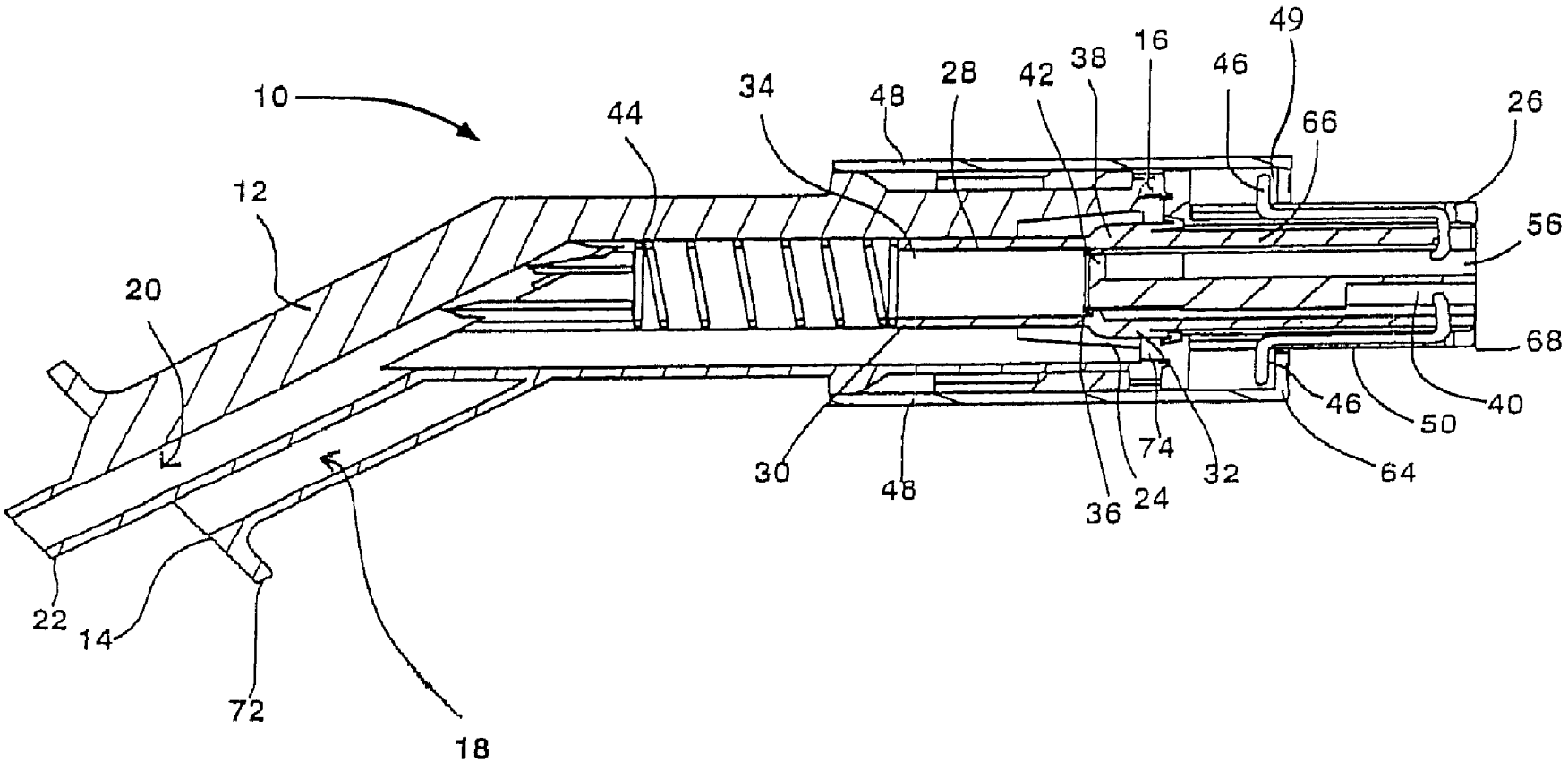
FIG. 2 is a cut away side view of the embodiment shown in FIG. 1 when the valve system is in a closed position.
Figure 3:
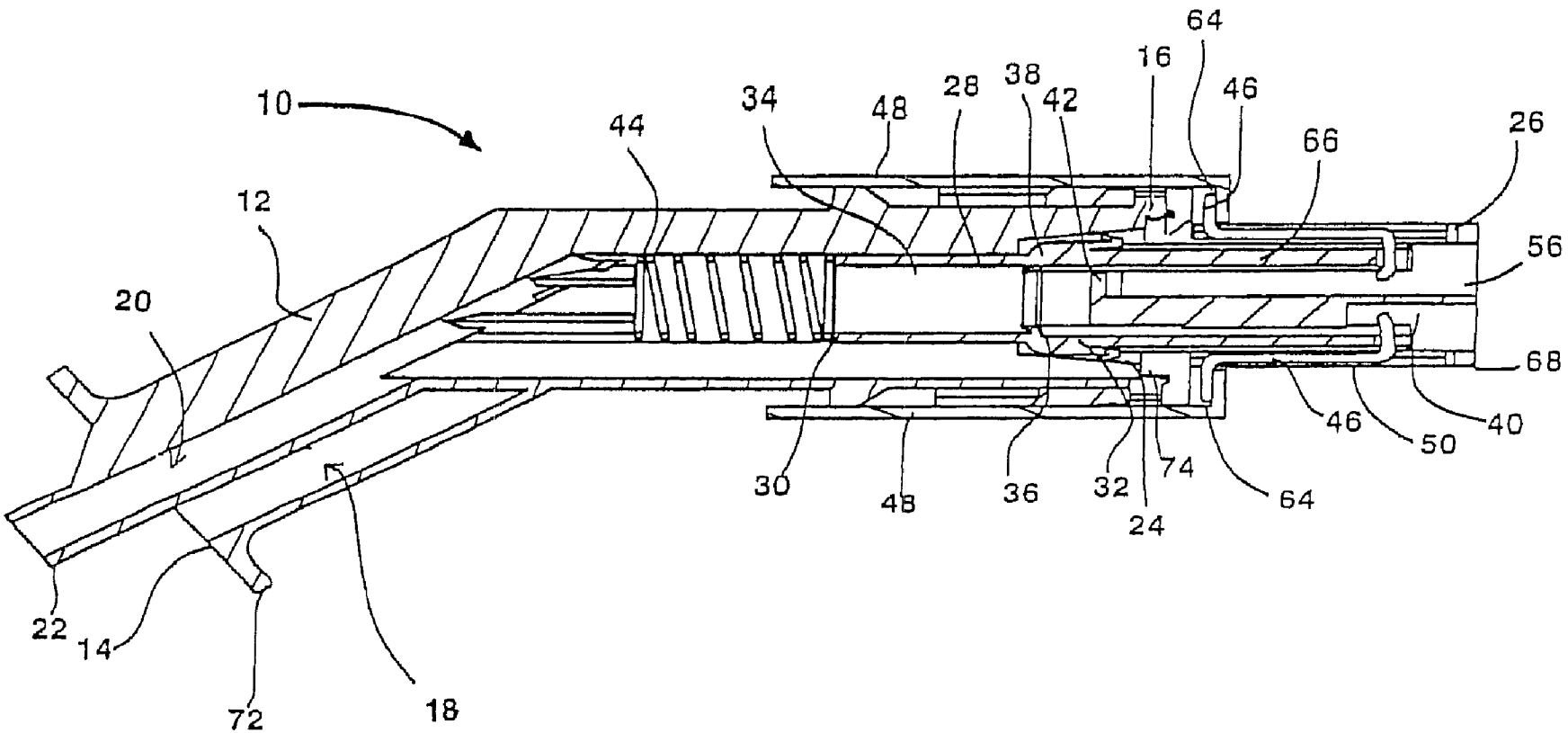
FIG. 3 is a cut away side view of the embodiment shown in FIG. 2 when the valve system is in an open position.

Referring now specifically to the Figures, FIG. 1 shows a side perspective view of one embodiment of the invented spout 10, detached from any liquid container, wherein the spout body 12, sheath 48, and nozzle unit 50 are the main features visible from the outside of the spout, and wherein the body 12 and nozzle unit 50 may be considered one example of a spout housing. FIGS. 2 and 3 show longitudinal cross-sectional views of the spout of FIG. 1 in the valve-closed and valve-opened positions, respectively. The spout 10 comprises spout body 12 having a hollow interior spout body passageway 18 (shown in FIGS. 2, 3, 4) which extends from the spout body open first end 14 to the spout body open second end 16. In this preferred embodiment, the spout body is angled about midway between the first and second ends 14, 16 at an oblique angle of about 150 degrees. However, other angles may also be used or, less preferably, a straight spout body with no angle may be used.

The spout body 12 is configured to receive an inner conduit 20, which extends out from the first end 14, through the spout body passageway 18 (shown in FIG. 2) defined within the spout body 12. The inner conduit 20 extends to a location within the filling container beyond where the pressure of fluid entering and exiting the container is roughly equivalent. This general level of opposing pressures, referred to hereinafter as the level of equalization, has a generally flattened parabolic shape. This shape represents the general level of equalization between the pressure of the liquid attempting to exit the device (created by gravity) and the pressure pressing against the liquid (created by the vacuum in the sealed container). The inner conduit 20 is positioned so that the inner conduit first end 22 extends through this level of equalization and allows the flow of air into the filling container via the spout. In a preferred embodiment, this overall length of the conduit 20 is typically less than three inches, of which about ⅝" extends into the container past the level of equalization. However, it is to be understood that this distance may be varied depending upon a variety of other factors.

The spout body 12 connects at or near its second end 16 with a nozzle unit 50, also called herein a "nozzle end." An outer sheath 48 is provided around a portion of the spout body 12 and nozzle unit 50. The sheath 48 is selectively adjustable in its position on the spout body/nozzle end for effecting opening of the valve system by means of an operative connection to a sliding sleeve 28 via a sliding clip 46 that extends through a slot in the nozzle unit 50. These items are show in detail in FIG. 2. The outer sheath 48 is rotated and slid along the spout body 12, which moves the sliding clip 46 back towards the first end of the spout body 12. This moves the sealing sleeve 28 (shown in FIG. 2), and liquid is then able to flow out of the filling container and spout in a smooth and controlled manner.

The nozzle end 50 has an end portion 68 that is generally hollow to allow the passage of fluid, both liquid and air, through the internal passageways of the spout, as discussed in more detail elsewhere in this Description. In a preferred embodiment, the diameter of this end portion 68 device is 0.8" and the diameter is configured to fit within a variety of types of containers. However, a variety of other dimensions may also be utilized depending upon the needs of the user.

The first end 14 of the spout body is configured for connection and fluid-sealing with an opening of a non-vented filling container. Typically, such a container has an opening and a cap or lid which attaches to the container through a threaded type cap-connecting device. The first end 14 of the spout body contains a sealing flange 72 that provides a generally smooth and flat surface that can cooperate with a lip portion of a container so that, for example, when combined with a standard nozzled gas can gasket and threaded cap, a leak-proof seal is provided.

FIG. 2 shows a detailed, cross-sectional side view of the embodiment of FIG. 1 when the spout valve system is in a closed position. This figure shows the inner conduit 20 or "vent tube", with its first end 22 and second end 24, located generally within the hollow space of the spout body. In this preferred embodiment, the inner conduit 20 is comprised of two portions which intersect at the elbow portion of the conduit 20. The inner conduit 20 may be formed by structure that is molded into the spout body, as is shown to best advantage in FIG. 4. Inside a larger-diameter portion of the conduit 20 is placed a biasing spring 44, designed to apply a desirable amount of pressure upon a sealing sleeve 28.

The sealing sleeve 28 has a generally open first end 30 and a generally open bell-shaped or generally campanulate second end 32. This second end 32 has a bell-shaped outer portion 38 that is configured to interact with a sealing portion on the spout housing (preferably on "ridge" 74 of the nozzle unit) to maintain a seal so as to prevent the flow of fluid material out of the spout. This bell-shaped second end 32 (at its interior surface 36) is also configured to interact with a seal extending in from the nozzle end of the spout generally near the central axis of the spout housing (preferably, a stopper 42 at or near the central axis of the nozzle unit 50), so as to block the passageway from the nozzle end 50 through the inner conduit 20 and into the filling container.

Thus, the generally hollow sealing sleeve 28 surrounds and defines a sealing sleeve passageway 34, which is configured to allow air to flow from the nozzle end 50, through the sealing sleeve passageway 34, through the internal conduit 20, and into the storage container when the connection between the stopper 42 and the sealing sleeve 28 is relaxed. This combination of a portion 80 of the nozzle end 50, sealing sleeve passageway 34, and inner conduit 20 form this example of the an air flow passageway.

Thus, the inner conduit 20 or "vent tube" and the inner sleeve 28 are positioned within the interior hollow space of the spout body, in effect, to define a passage within a passage. The remainder of the interior hollow space of spout body, in effect, forms the spout body passageway 18, which extends past/around the outside of sealing sleeve 28 (when the seal between the bell-shaped outer portion 38 and sealing ridge 74 is relaxed), and which connects to a portion of the nozzle end 50, form this example of a liquid flow passageway.

The sealing sleeve 28 prevents the flow of liquid out of the device by blocking/closing the liquid passageway via close compressive engagement of the bell-shaped outer portion 38 of the sealing sleeve 28 against an sealing ridge 74 located within the nozzle end 50. This seal between the bell-shaped portions 38 of the sealing sleeve 28 and the sealing ridge 74 is maintained by pressure exerted by a biasing spring 44.

The generally campanulate second end 32 of the sealing sleeve 28 is also involved in sealing the air passageway, in that preferably an inner surface/portion 36 of the generally campanulate second end 32 is held in an engaged position against the stopper 42 by the biasing spring 44. This prevents the flow of air through the sealing sleeve interior passageway 34 and the inner conduit 20.

In the valve-closed position, the outer sheath 48 preferably is not configured to engage any portion of the sliding clip 46. In the valve-closed position, the sliding clip 46 does not engage the extension portions 66 of the sealing sleeve, so that the sealing sleeve 28 preferably will not be moved.

One may note from FIG. 2 that, when the preferred valve system is closed, there is a small gap 49 between the proximal end of the arm of the clip 46 and the flange of the sheath. For example, a gap of 1-10 mm, and preferably 2-5 mm, may be effective. This provides some leeway in the construction of the spout, to allow for manufacturing tolerances, so that the valve system will seal completely and reliably even when manufacturing is not perfect. Further, the gap provides some leeway in the operative connection/engagement of the clip and the sheath, and, hence, some leeway or "delay" in the actuation of the sliding sleeve 28. This way, some movement of the sheath member 48 and/or the clip 46 may occur without the valve sleeve 28 becoming dislodged from its liquid and air passageway sealing position. This way, an intentional effort, rather than a tap or bounce, is needed to unseal the valve so that leaking is minimized or eliminated during transport and handling of the device.

Referring now to FIG. 3, shown is a detailed cross-sectional side view of the spout with the valve system in an open position. In this open position, the sheath 48 and sliding clip 46 have been moved toward the first end of the spout, pushing the extension portions 66 of the sealing sleeve 28 also toward the first end of the spout against the bias of the spring 44, so as to allow the campanulate shaped outer portions 38 of the sealing sleeve 28 to be removed from contact with the sealing portion/ridge 74, and the inner portions 36 of this bell-shaped second end to be removed from contact with the stopper 42. When this occurs, air is able to flow from the nozzle unit second end 68 though a portion of the nozzle unit 50 interior, through the sealing sleeve passageway 34, through the inner conduit 20 and into the filling container. In addition, liquid is then able to flow from the storage container through the spout body passageway 18, through a portion 82 of the nozzle unit interior, and out of the open nozzle unit end 68.

When the filling container is positioned in a filling position and removal of the liquid contents of the container is desired, the outer sheath 48 is positioned so as to prevent impediment by the child resistant features and the outer sheath 48 is pulled back. In the preferred embodiment, this is accomplished by twisting the outer sheath 48 and pulling the outer sheath 48 back towards the storage container.

As discussed earlier in this document, the first end 22 of the inner conduit 20 extends sufficiently far into the filling container so as extend beyond a level of equalization between air and liquid that is created when a container is inverted into a pouring position. Throughout the length of the spout body 12, the inner conduit 20 is configured and intended to transfer air, and the passageway 18 which is defined by the spout body is configured and intended to transfer liquid, to maintain air and liquid in separate chambers/channels. However, at the transition location between the spout body 12 and the nozzle unit 50 this physical separation ends. However, the configuration of the bell-shaped outer portions 38 of the end 32 of the sleeve 28 discourages the passage of excess liquid into the airflow passageway when the spout 10 is in use.

The bell-shaped outer portion 38 of the sleeve is configured to direct the flow of liquid through the liquid passageway over (around) the sealing sleeve 28, and to maintain an opening within the sealing sleeve 28 so as to allow passage of air through the sealing sleeve passageway 34 and into the inner conduit 20. This configuration creates a venture-type effect, which encourages accumulated liquid to exit the sleeve hollow passageway 34 and the inner conduit 20, which are intended for the passage of air only. This configuration discourages liquid and air from traveling in opposite directions within the same chamber/channel. This separation of liquid and air passageways facilitates the transfer of liquid out of the device and the flow of air into the device; this further produces a smooth flow of liquid out of the storage container.

In order to place the spout in the open position shown in FIG. 3, the outer sheath 48 must be twisted and slid to engage a sliding clip 46, which is configured to engage a portion of the sealing sleeve 28. When this occurs, the sealing sleeve 28 is pushed back against the biasing spring 44, compressing the biasing spring 44 and pushing the inner sleeve 28 apart from the stopper 42 and the inner sealing ridge 74. As shown in FIG. 3, when the device is in this position, air and liquid are configured to exchange positions (that is, air into the spout and filling container and liquid out of the spout and into the receiving container) and the liquid will flow appropriately through the spout.

When pressure on the outer sheath is relaxed, the biasing spring 44 pushes the sealing sleeve 28 forward against the inner sealing portion 74 and the stopper 42. The flow of material into or out of the container is stopped. By limiting the amount of pressure applied against the biasing spring 44 the distance between the sealing sleeve 28 and the inner ridge 74 and the stopper 42 may be varied and thus the rate of flow of material out of the device controlled. The "pedestal-shaped" stopper 42 and slidable sleeve 28 are configured so that the stopper 42 is generally never fully extracted from within the generally campanulate portion of the sliding sleeve 28.

Further, as discussed above, the spout is configured so that the size of the aperture through which the liquid flows decreases proportionately from a larger volume portion to a smaller volume portion. As a result, a smooth, controlled flow of air and liquid is maintained and gurgling or splashing of the liquid is reduced, which has significant advantages over the devices available in the prior art. In addition, the slidable projections 66 on the slidable sleeve 28 interact with portions of the nozzle unit 50 to provide a telescoping channel that maintains a separation between the liquid leaving the nozzle and the air that is entering the nozzle. This embodiment is discussed in more detail in the paragraphs that describe FIG. 6.

Referring now to FIGS. 4-10, individual pieces of the preferred embodiment are shown and described. While the configurations of the embodiments are disclosed, it is to be distinctly understood that the invention is not limited thereto, but that this disclosure is simply to be illustrative and not limiting and to set forth the best mode known for practicing the invention.

Figure 4:
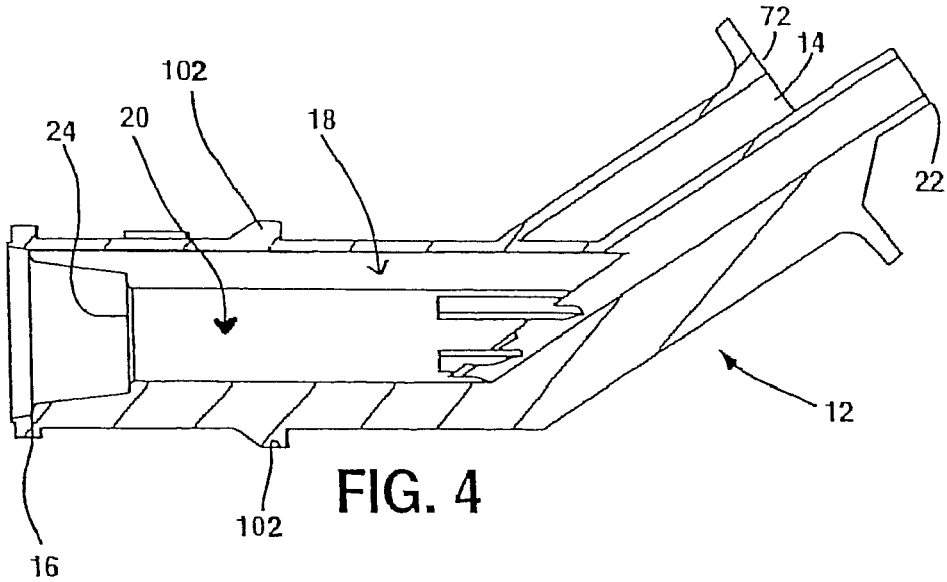
FIG. 4 is a cut away side view of the spout body portion of the embodiment of FIGS. 1-3.
Figure 4A:
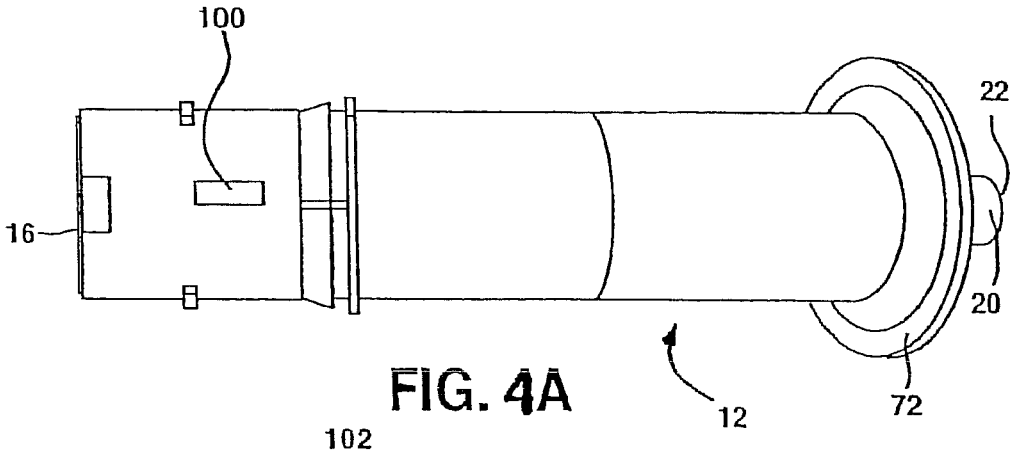
FIG. 4A is a top perspective view of the spout body portion of FIG. 4.
Figure 4B:
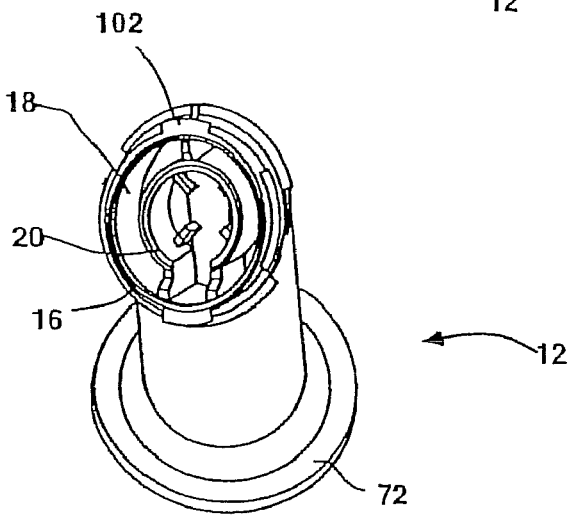
FIG. 4B is a perspective end view of the spout body of FIG. 4A.

Referring now to FIGS. 4 and 4A, 4B a variety of views of the spout body 12 are shown. While, in this embodiment, the nozzle unit 50 (shown in FIG. 5) and the spout body 12 are shown as being two pieces that can then be connected together, the nozzle unit 50 and the spout body 12 may alternatively be formed as a single piece. Other modifications may be made to the shout housing, for example, for ease or economy of manufacturing.

Figure 5A:
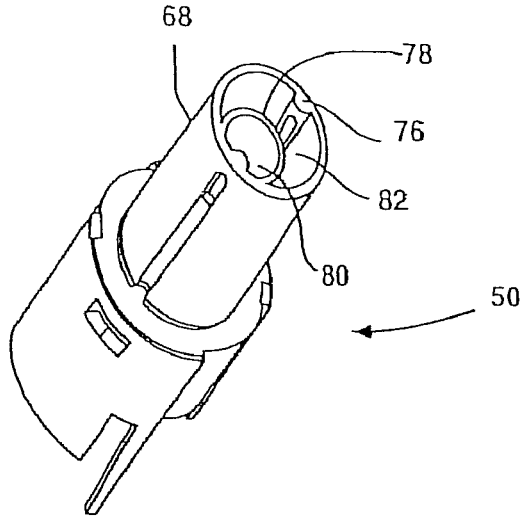
FIG. 5A is a side perspective view of the nozzle end portion of the embodiment of FIGS. 1-3.
Figure 5B:
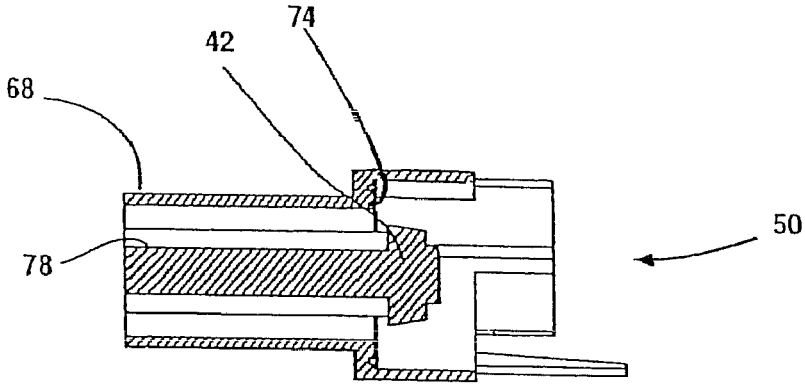
FIG. 5B is a cut away side view of the nozzle unit of FIG. 5A.
Figure 5C:
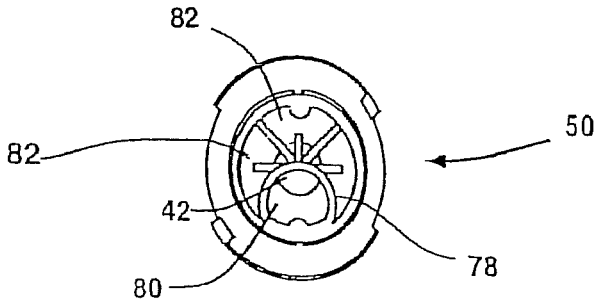
FIG. 5C is a front-end view of the nozzle unit shown in FIGS. 5A and B.

FIGS. 5A, 5B, and 5C show the nozzle unit 50, which connects to the spout body 12 and comprises the stopper portions 42 and sealing ridge 74 described previously. Additionally, this device includes a partition 78 that divides the nozzle unit 50 into an airflow portion 80 and a liquid flow portion 82. In order to assist with the proper alignment of the sliding sleeve 28 within the nozzle unit 50, a series of alignment projections 76 are also included within the nozzle unit 50.

The preferred nozzle unit 50 childproof lock features cradles 102 that impede the longitudinal movement of the outer sheath 48 unless the sheath is appropriately twisted (rotated) to allow the projections 100 on the outer sheath 48 to clear the cradles 102. Other child-proof lock systems, as may be understood by one of skill in the art, may be used, or, less-preferably, no childproof lock may be used.

In the preferred embodiment, the open second end 68 of the nozzle end 50 is dimensioned to have a diameter of 0.8 inch, which size fits most fuel tanks. The spout provides a pour rate that is semi-adjustable depending upon the compression of the biasing spring and, at full-open, the spout produces a flow that exceeds two gallons per minute. The overall shape and length of the spout will accommodate a very high percentage of the application requirements for portable petroleum distillate storage containers.

Figure 6:
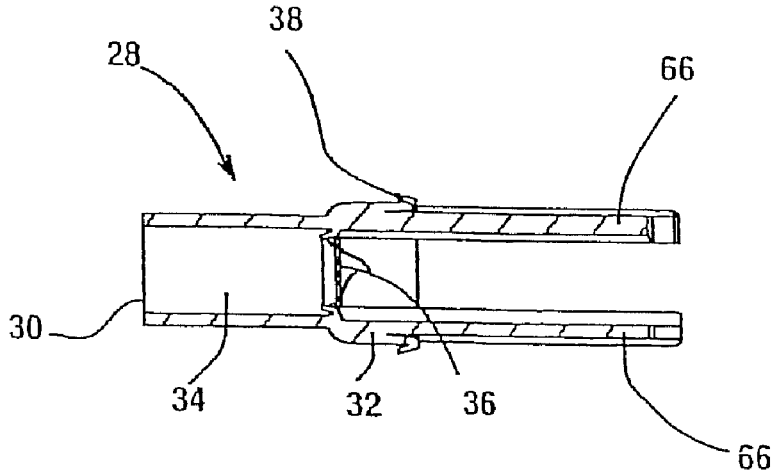
FIG. 6 is a cut away top view of the slidable sleeve of the embodiment of FIG. 1-3.

Referring now to FIG. 6, several views of the sealing sleeve 28 are shown. In the preferred embodiment, the sealing sleeve 28 could be appropriately described as "corolla" having a variety of components extending from a central structure. The sealing sleeve 28 generally hollow interior with first and second open ends 30, 32 forms sealing sleeve passageway 34.

The sealing sleeve 28 projection portions 66 extend into the nozzle end 50 and are configured to cooperate with multiple arms of the sliding clip 46. These projection portions 66 align with alignment portions 76 of the nozzle unit 50 to maintain alignment of the sliding sleeve 28 within the spout body 12 and the nozzle unit 50. The alignment portions 76 also have a channel for sliding clip 46. The interface between these projections 66 and the "rib-shaped" partition 78 further assist to isolate the flow of air from the flow of liquid that are flowing in opposite directions through the spout and the nozzle unit.

Figure 8:
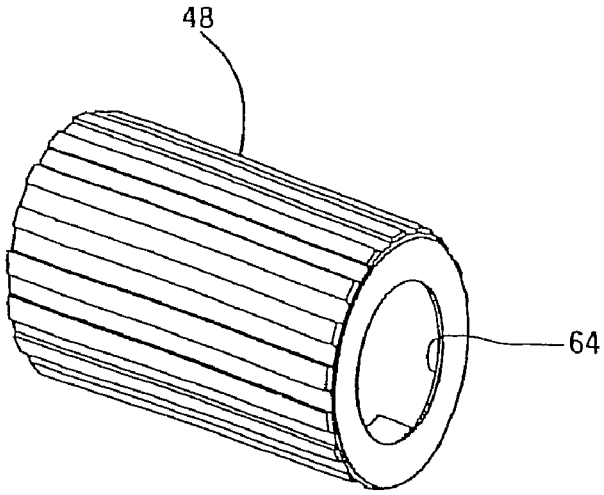
FIG. 8 is a perspective side view of the outer sheath of the embodiment of FIGS. 1-3.
Figure 8A:
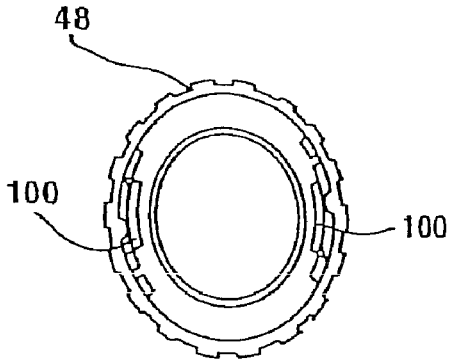
FIG. 8A is an end plan view of the outer sheath of FIG. 8
Figure 8B:
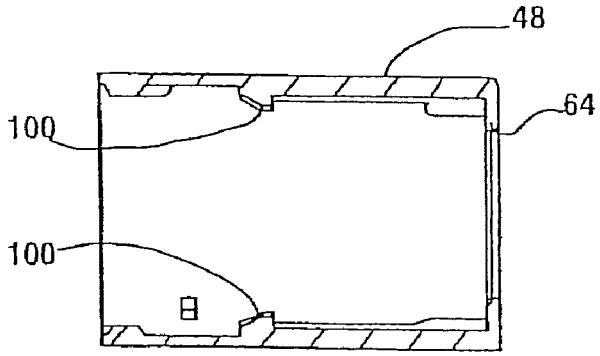
FIG. 8B is a cutaway side view of the outer sheath of FIGS. 8 and 8A.
Figures 9A, 9B, 9C, 9D, 9E, 9F:
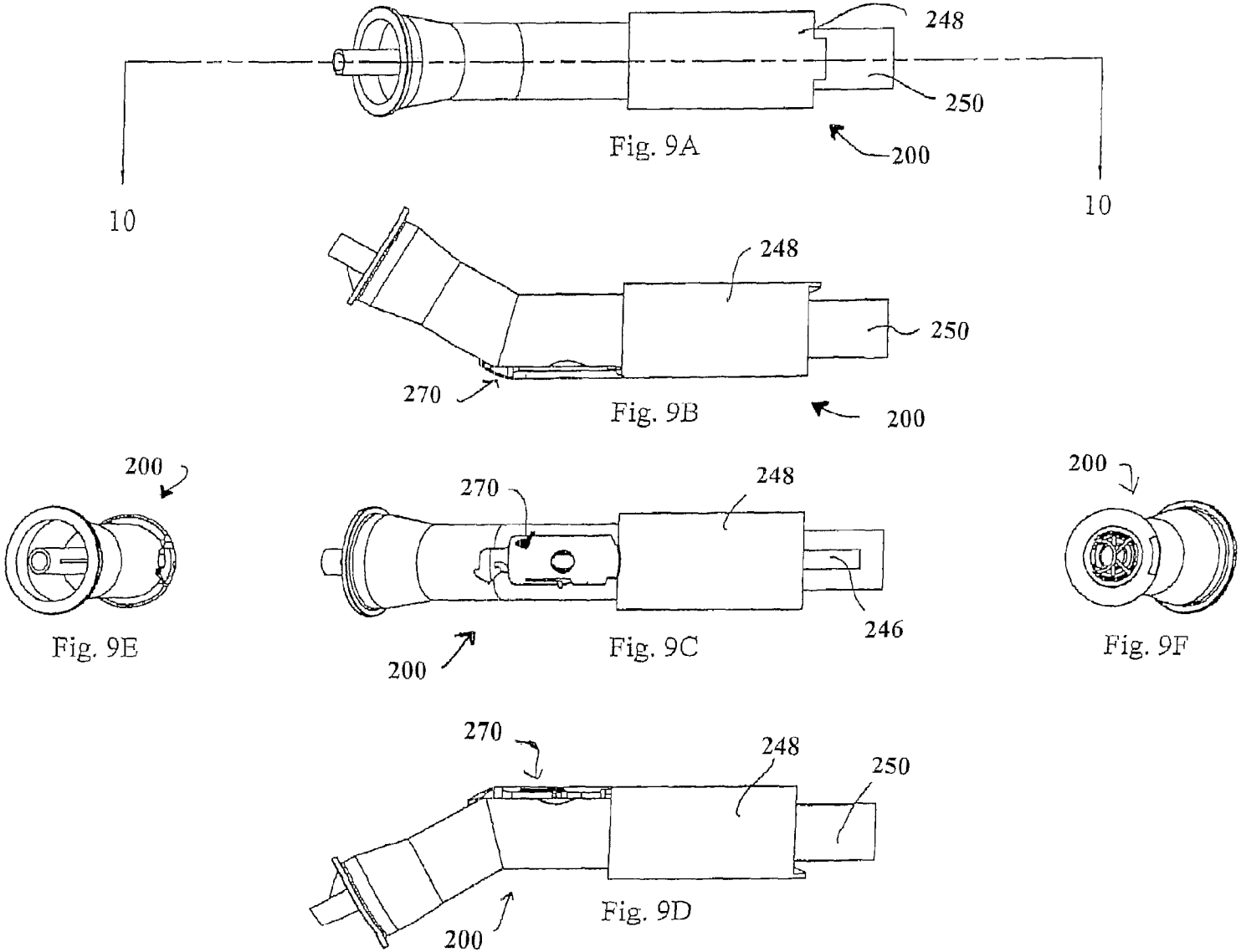
FIGS. 9A-9J are various views of an especially-preferred embodiment of the invented spout.
Figure 9G:
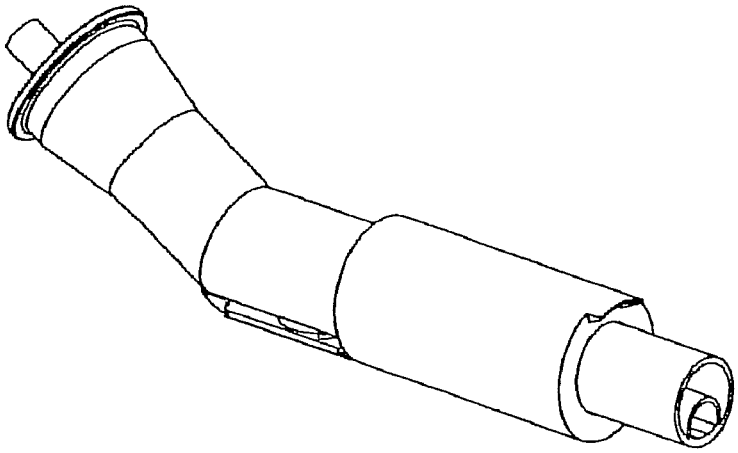
Figure 9I:
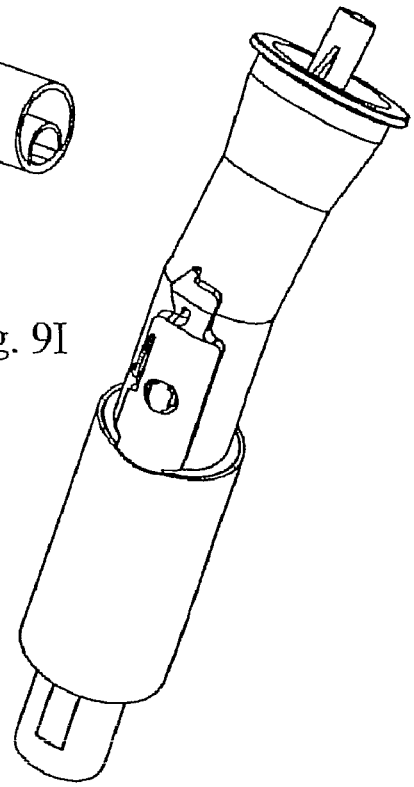
Figure 9H:
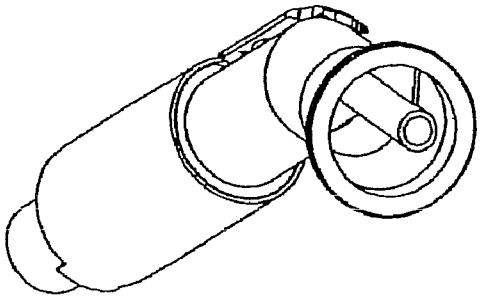
Figure 9J:
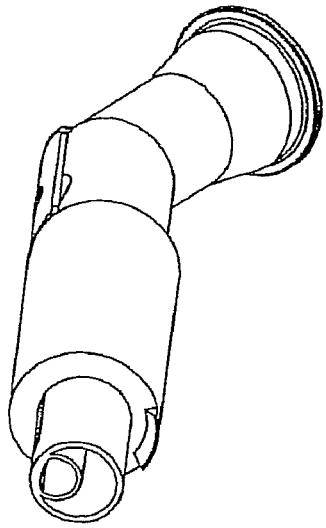

The configuration of the projections 66 and the partition 78 provide a telescoping half and half type of telescoping tube that prevents unimpeded air flow into the interior of the sliding sleeve 28, through the passageway 34 and up into the filling container. Several views of the sliding clip 46 are shown in the attached FIGS. 7A-7F, and several views of the outer sheath 48 are shown in the attached FIGS. 8, 8A, and 8B.

With a slight delay, as the sheath movement passes the child-resistant feature, the projections of the internal face of the sheath 64 engage the sliding clip 46 which in turn push back upon the projections 66 of the sliding sleeve 28. This movement can be accomplished by either a user twisting (rotating) and pulling the sheath 48 back or by twisting (rotating) the sheath 48 to the hold position, inverting the container, and pushing an outer portion of the sheath 48 against the lip of the receiving container. When this occurs, the sliding sleeve 28 releases the connection between the inner and outer surfaces of the campanulate portion of the sealing sleeve valve and the stopper 42 portion of the partition, and the inner sealing surfaces ("ridge") 74, respectively. When the pressure upon the outer sheath is released, the biasing spring 44 pushes the sleeve 28 back up against the stopper 42 and the sealing surfaces 74 and any further flow of material out of the device 10 is prevented.

An especially-preferred spout 200, illustrated in FIGS. 9A-14I, is constructed and works generally the same as the spout of FIGS. 1-8C, except that it features an improved sleeve actuation system, an improved sliding sleeve, and alternative child-resistant features. The combined effect of the improved sleeve actuation system and sliding sleeve may be enhanced economy of manufacture and also reduced chance of "sideways splash" from the spout. The alternative child-resistant features make operation of the spout easier and more readily apparent for adults, while still being resistant to operation by children.

Figures 13A, 13B, 13C, 13D, 13E, 13F, 13G, 13H, 13I, 13J, 13K, 13L, 13M, 13N, 13O, 13P, 13Q:
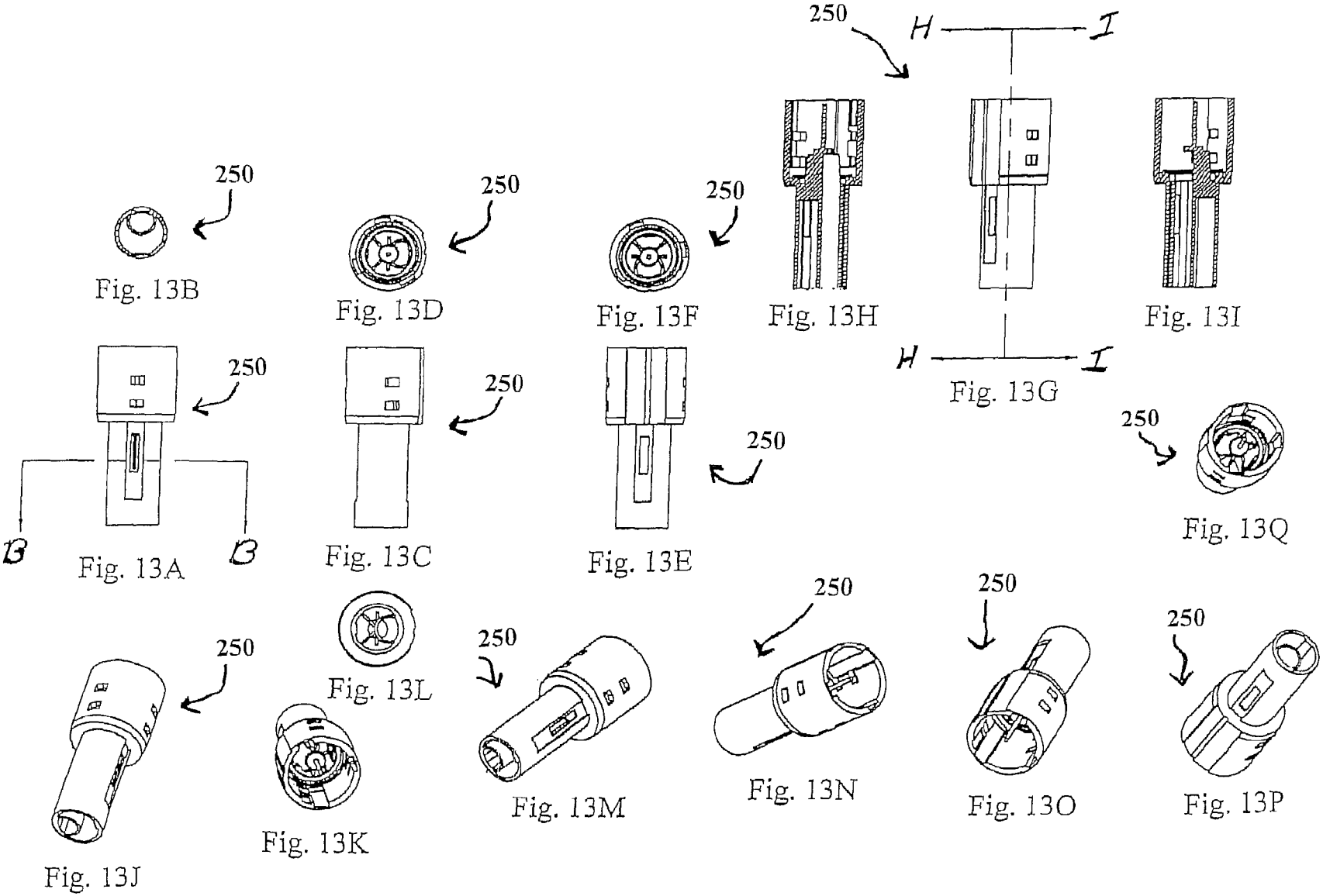
FIGS. 13A-Q are various views of the nozzle unit of the embodiment of FIGS. 9A-10.
Figures 14A, 14B, 14C, 14D, 14E, 14F, 14G, 14H, 14I:
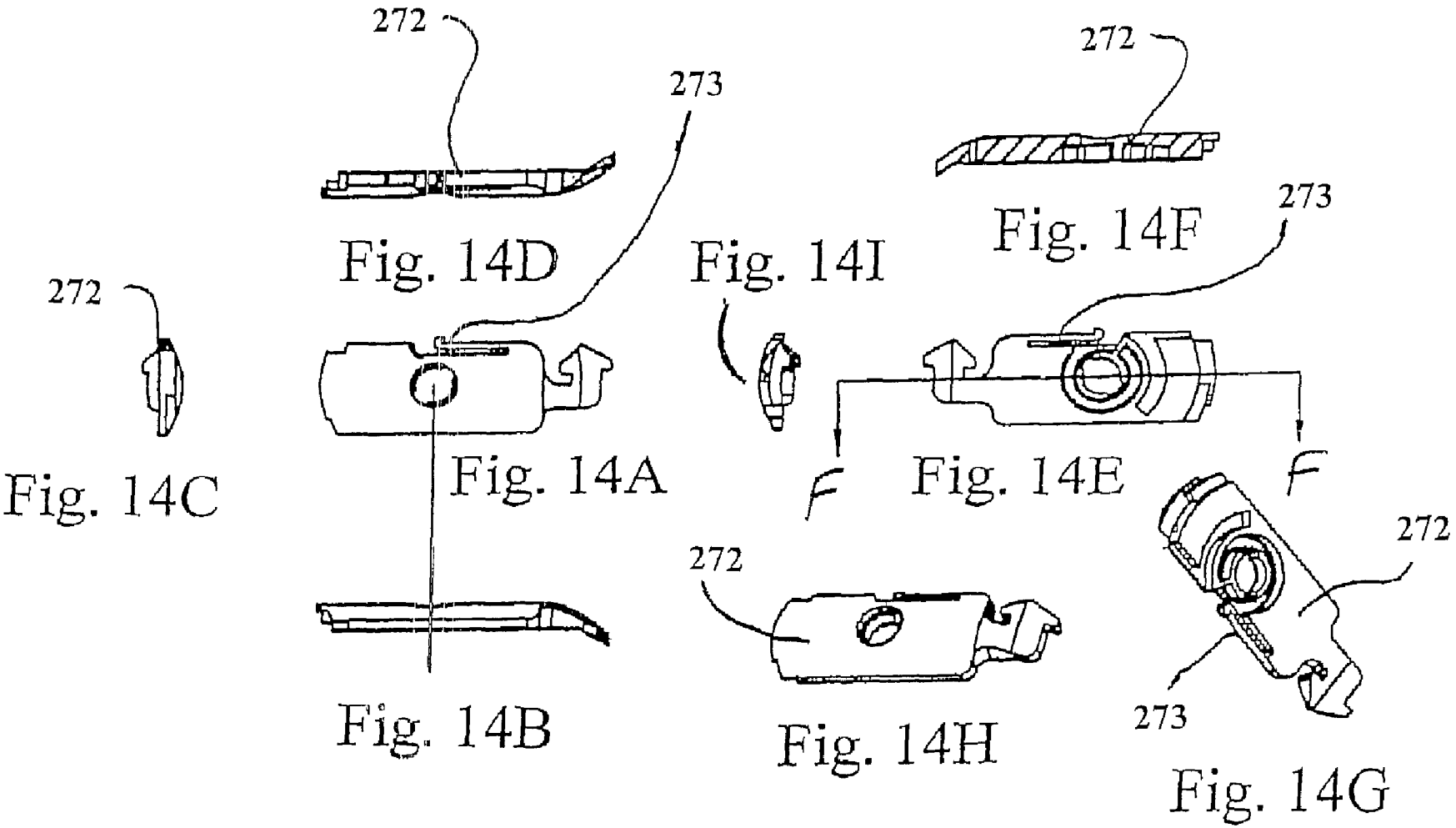
FIGS. 14A-I are various views of one child-resistant swivel lock that may be applied to the spout of FIGS. 9A-10.

The general appearance of the especially-preferred spout is portrayed in the several views of FIGS. 9A-J. The internals of the spout are portrayed in FIG. 10, wherein the valve system of the spout is in the closed, sealed position. FIGS. 11A-G illustrate the especially-preferred slidable sleeve, FIGS. 12A-E illustrate the especially-preferred sliding clip, and FIGS. 13A-Q illustrate the especially-preferred nozzle unit. FIGS. 14A-I illustrate details of the child-resistant lock of this embodiment.

Figure 6A:
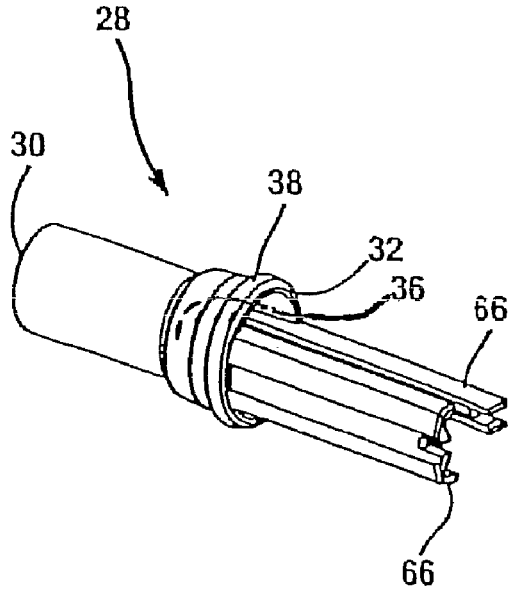
FIG. 6A is a side perspective view of the slidable sleeve of FIG. 6.

An alternative sliding clip 246 may be molded from plastic, which provides advantages, for example, to a manufacturer of the spout who is already is engaged in and knowledgeable in molding technology. The clip 246 has a single arm 247 and a single engagement tab 247' for engaging a single engagement portion 266 of the improved sleeve 228. As may be noticed from FIGS. 11A-G, sleeve 228 has only the one, top engagement portion 266, and is missing the "lower" engagement portion 66 of sleeve 28 in FIG. 6 (and shown to the right rear of FIG. 6A). Clip 246 is capable of engaging and sliding the sleeve 228 by only using a single arm 247 engaging the single engagement portion 66. There is no need for a second clip arm to extend around to the "bottom" of the spout to engage a "lower" engagement portion 66. This has the benefit of eliminating the need for an aperture through the nozzle unit 250 at its lower/bottom side (orientation as viewed in FIG. 10) to receive a clip arm, and, consequently, of eliminating the chance of "sideways" splash or leaking through such a lower aperture. Also, the arm 247 of the clip 246 is generally a flat plate that may act as a splash guard to prevent "sideways" splash out of the nozzle unit aperture through which tab 247' extends to engage sleeve 228.

The child-resistant lock system 270 of this embodiment includes a large rotatable and latchable handle 272 on the surface of the spout body. This handle 272 may be latched to lie longitudinally to lock the sheath 248 from sliding, by abutting against an end of the sheath. When a user wishes to unlock the sheath, the handle 272 may be unlatched by squeezing the handle (at latch arm 273) and swiveled/rotated about 90 degrees to place the narrow dimension of the handle 272 facing the sheath, providing room for movement of the sheath. This lock system is advantageous because it is very visible and easily-understandable for an adult, while typically being too difficult for a child to operate. The handle 272 may latch and unlatch by various means, as will be understood by one of skill in the art after viewing the Figures.

Figure 10:
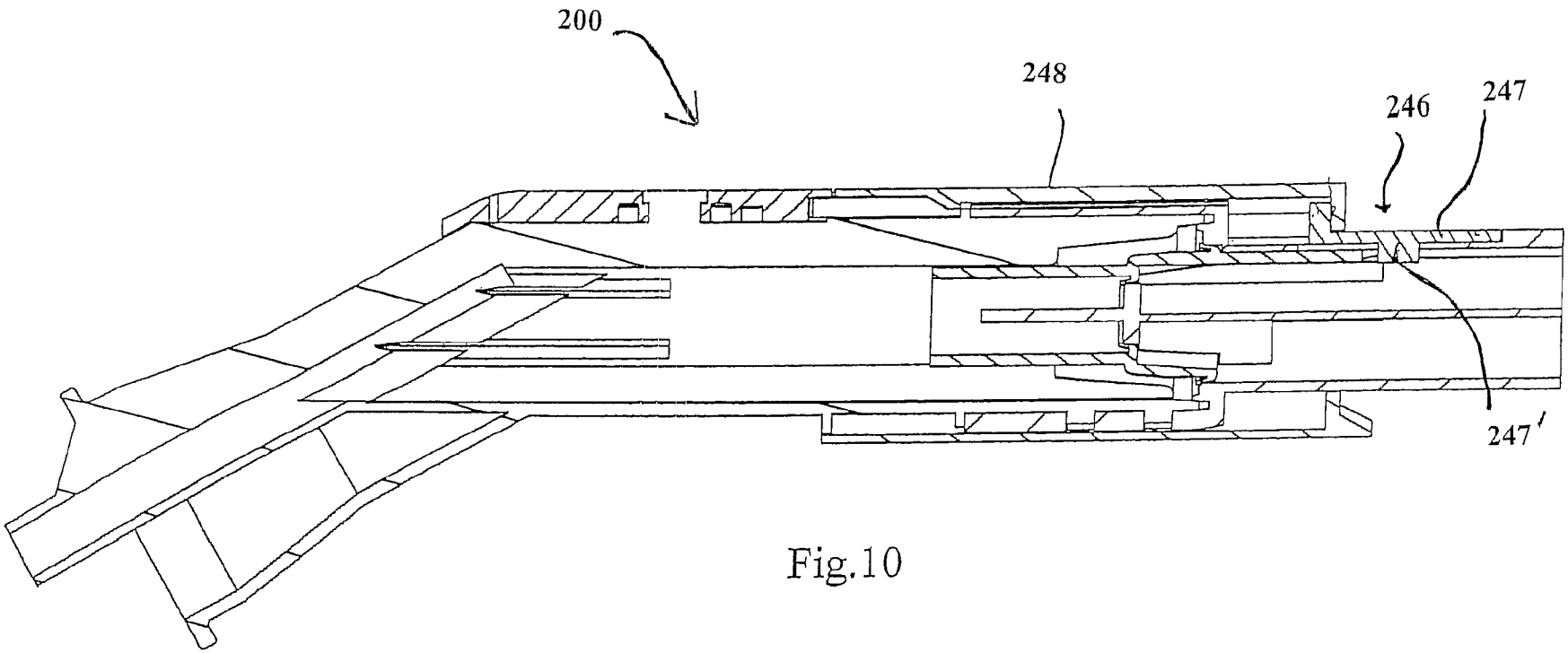
FIG. 10 is a cross-sectional side view of the spout of FIGS. 9A-J, viewed along the line 10-10 in FIG. 9A.
Figures 11A, 11B, 11C, 11D, 11E, 11F, 11G, 12A, 12B, 12C, 12D, 12E:
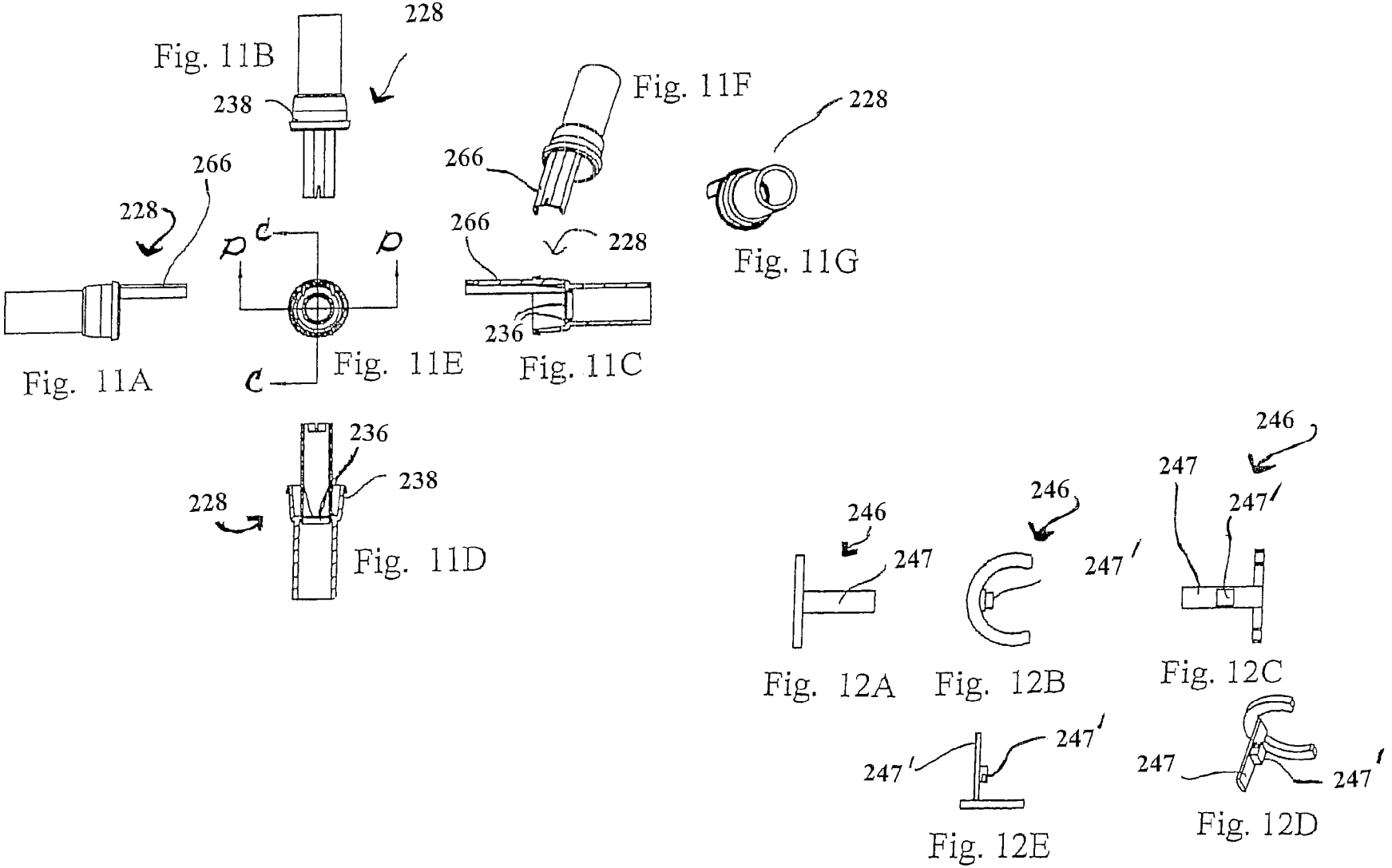
FIGS. 11A-G are various views of the slidable sleeve of the embodiment of FIGS. 9A-10.
FIGS. 12A-E are various views of the slidable clip of the embodiment of FIGS. 9A-10.

While FIG. 10 does not show a gap between the sheath 248 and the clip 246 when the valve is in the closed position, it is still preferred that there be a small gap there between. As described above regarding FIG. 2, such a gap allows some manufacturing tolerances while still obtaining a complete and reliable seal, and such a gap or other slight "delay" in sleeve actuation also helps prevent the jostles and bumps of normal storage and handling from relaxing or opening the valve seals and consequently leaking or spilling. In other words, it is preferred that manual movement of the external sheath causes contact with an connecting member, which, in turn moves the intermediate sleeve to open the spout, but that a space/gap is provided between at least two of the three members of this system (sheath-connecting member-sleeve), so that there is some leeway in the construction and function of those three members. This way, the sheath and/or the spout can be bumped, tapped, or jolted slightly without causing engagement of the connecting member and the subsequent sliding of the intermediate sleeve to open the spout, thus reducing sensitivity of the spout opening mechanism and reducing leaking.

While there are shown and described the present preferred embodiments of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

Although this invention has been described above with reference to particular means, materials and embodiments, it is to be understood that the invention is not limited to these disclosed particulars, but extends instead to all equivalents within the scope of the following claims.

I claim:

1. A self-venting spout comprising:

an elongated spout housing comprising:

an open first end for connection to a container for liquid, an open second end for dispensing liquid, and an interior spout surface surrounding and defining an interior passageway extending between said open first end and open second end, a distal portion of the interior passageway having a longitudinal axis and a radial dimension;

a sealing ridge in said interior passageway near said interior spout surface, and a stopper generally centered in said interior passageway and radially distanced from said interior spout surface and from said sealing ridge; and a slidable sleeve in said interior passageway that is slidable parallel to said longitudinal axis, said slidable sleeve comprising a generally tubular portion having an outer surface with a first annular seal and an inner surface defining a sleeve passageway and having a second annular seal;

wherein, when said slidable sleeve is in a spout-closed position, said first annular seal contacts and seals against said sealing ridge of the spout housing, and said second annular seal contacts and seals against said stopper;

wherein, said spout comprises partition walls dividing said interior passageway into an air-flow passageway portion and a liquid-flow passageway portion, and wherein, when the slidable sleeve is in the spout-closed position, said sealing of the first annular sleeve and the sealing ridge blocks said liquid-flow passageway portion and said sealing of the second annular seal and the stopper blocks said air-flow passageway portion; and wherein, when said slidable sleeve is slid longitudinally to a spout-open position, said first annular seal is distanced from the sealing ridge to open said liquid-flow passageway portion and said second annular seal is distanced from the stopper to open said air-flow passageway portion; and wherein the spout further comprises a spring configured to bias the slidable sleeve into the spout-closed position, and an actuation system including an external member located on, and slidable on, an outside surface of the spout, wherein the external member is operatively connected to the slidable sleeve by a connecting member, so that sliding of said external member moves said slidable sleeve inside the spout between said spout-closed and spout-open positions.

2. A spout as in claim 1, wherein said external member is an outer sheath that is slidable on said spout housing; and wherein said outer sheath is operatively connected to the slidable sleeve by a connecting member that extends from near said outer sheath and through said spout housing and that engages said slidable sleeve; and said outer sheath being configured to engage said connecting member so that sliding said outer sheath longitudinally on the spout housing pulls the connecting member longitudinally to move the slidable sleeve from said spout-closed position to said spout-open position.

3. A spout as in claim 2, wherein said connecting member is a clip that extends from near said outer sheath and through said spout housing and that engages said slidable sleeve;

said outer sheath being configured to engage said clip so that sliding said outer sheath longitudinally on the spout housing pulls the clip longitudinally to move the slidable sleeve from said spout-closed position to said spout-open position.

4. A spout as in claim 3, wherein said outer sheath is rotatable on the spout housing, and wherein said outer sheath is configured to be slidable along the spout housing only when the outer sheath is in one or more selected rotational positions.

5. A spout as in claim 3, wherein said spout housing comprises a body and a nozzle unit generally coaxially connected, wherein said nozzle unit comprises said sealing ridge and said stopper, and wherein said slidable sleeve has at least one longitudinal projection extending toward said second end, wherein said nozzle unit is generally hollow and receives said longitudinal projection, said nozzle unit having at least one alignment protrusion extending radially inward toward said longitudinal projection and engaging said projection; and wherein said clip connects to said at least one longitudinal projection for moving the slidable sleeve.

6. A spout as in claim 3, wherein said clip extends through said spout housing at only one aperture so that sideways splash out of the spout housing is minimized.

7. A spout as in claim 3, wherein said clip has a single arm extending through an aperture in said spout housing and engaging said slidable sleeve; and wherein said single arm of the clip has a generally flat extension that covers said aperture so that sideways splash out of the spout housing is minimized.

8. A spout as in claim 3, further comprising a swivelable elongated lock on said spout housing, wherein, when the lock is swiveled to be longitudinal on the spout housing, an end of the lock abuts against the outer sheath to prevent the outer sheath from sliding on the housing.

9. A spout as in claim 3, wherein there is a gap between said clip and said outer sheath when said slidable sleeve is in the spout-closed position, for providing leeway in the engagement of the outer sheath with the clip for minimizing leaking of the spout.

10. A spout as in claim 2, wherein there is a gap between said connecting member and said outer sheath when said slidable sleeve is in the spout-closed position, for providing leeway in the engagement of the outer sheath with the connecting member for minimizing leaking of the spout.

11. A spout as in claim 2, wherein, when the slidable sleeve is in the spout-closed position, there is a gap in said actuation system between at least two of three members of said actuation system, said three members consisting of said outer sheath, said connecting member, and said slidable sleeve, for providing leeway in the engagement of said three members for minimizing leaking of the spout.

12. A spout as in claim 1, wherein said spout housing comprises a body and a nozzle unit generally coaxially connected, wherein said nozzle unit comprises said sealing ridge and said stopper.

13. A spout as in claim 12, wherein said slidable sleeve has at least one longitudinal projection extending toward said second end, and wherein said nozzle unit is generally hollow and receives said longitudinal projection, said nozzle unit having at least one alignment protrusion extending radially inward toward, and engaging, said longitudinal projection.

14. A spout as in claim 1, wherein the liquid-flow passageway portion comprises a proximal portion near said first end of the spout housing and a distal portion near said second end of the spout housing, wherein said distal portion is smaller in volume than said proximal portion for creating a venturi effect as the liquid flows through said liquid-flow passageway portion toward the second end.

15. A spout as in claim 1, wherein said spout housing has a proximal portion near said first end of the spout housing and a distal portion near said second end of the spout housing, and said proximal portion and distal portion are at an angle to each other.

16. A spout as in claim 1, wherein said air-flow passageway portion is defined near said spout housing first end by a generally tubular extension out from the spout housing that is configured to extend into the liquid container farther than the first end of the spout housing so that the pressure in the generally tubular extension is less than the pressure in the liquid-flow passageway portion at the first end of the spout housing.

17. A spout as in claim 1, wherein said first annular seal is a portion of a bell-shaped outer surface of said sleeve.

18. A spout as in claim 1, wherein said spring is received in said interior passageway.

19. A self-venting spout comprising:

an elongated spout housing having an interior volume comprising an interior liquid-flow passageway and an interior air-flow passageway both extending between a first end of the spout housing and a second end of the spout housing, said air-flow passageway being generally centered on a longitudinal axis of the spout housing and said liquid-flow passageway radially offset from said air-flow passageway;

a stopper disposed in the air-flow passageway; and a sleeve slidably disposed in said interior volume and having an exterior surface defining a portion of said liquid-flow passageway and an interior surface defining a portion of said air-flow passageway, said sleeve further having a protruding first annular seal on said exterior surface and a protruding second annular seal on said interior surface;

wherein, when said sleeve is slid longitudinally to a spout-closed position, said first annular seal contacts and seals with a sealing ridge on said spout housing to seal closed the liquid-flow passageway to stop liquid from flowing from said first end to said second end of the spout housing, and said second annular seal contacts and seals to said stopper to seal closed the air-flow passageway to stop air from flowing from said second end to said first end of the spout housing; and wherein, when said sleeve is slid longitudinally to an spout-open position, said first annular seal is distanced from said sealing ridge to allow liquid to flow through the liquid-flow passageway past said first annular seal to said second end, and said second annular seal is distanced from the stopper to allow air to flow through the air-flow passageway past said second annular seal to the first end; and wherein the spout further comprises a spring configured to bias the sleeve into the spout-closed position, and an actuation system including an external member located on, and slidable on, an outside surface of the spout, wherein the external member is operatively connected to the sleeve by a connecting member, so that sliding of said external member moves said sleeve inside the spout between said spout-closed and spout-open positions.

20. A spout as in claim 19, wherein said external member is an outer sheath that is slidable on said spout housing; and wherein said outer sheath is operatively connected to the sleeve by a connecting member that extends from near said outer sheath and through said spout housing and that engages said sleeve; and said outer sheath being configured to move the connecting member longitudinally on the spout housing to slide the sleeve from said spout-closed position to said spout-open position.

21. A spout as in claim 20, wherein said connecting member is a clip member that extends from near said outer sheath and through said spout housing and that engages said sleeve;

said outer sheath being configured to move the clip member longitudinally on the spout housing to slide the sleeve from said spout-closed position to said spout-open position.

22. A spout as in claim 21, wherein the spout housing comprises a body and a nozzle unit generally coaxially connected, wherein said nozzle unit comprises said sealing ridge and said stopper, and wherein said sleeve has at least one longitudinal projection extending toward said second end, wherein said nozzle unit is generally hollow and receives said longitudinal projection, said nozzle unit having at least one alignment protrusion extending radially inward toward said longitudinal projection and engaging said projection; and wherein said clip member connects to said at least one longitudinal projection for moving the sleeve.

23. A spout as in claim 21, wherein there is a gap between said clip and said outer sheath when said sleeve is in the spout-closed position, for providing leeway in the engagement of the outer sheath with the clip for minimizing leaking.

24. A spout as in claim 20, wherein there is a gap between said connecting member and said outer sheath when said sleeve is in the spout-closed position, for providing leeway in the engagement of the outer sheath with the connecting member for minimizing leaking.

25. A spout as in claim 20, wherein, when the sleeve is in the spout-closed position, there is a gap in said actuation system between at least two of three members of said actuation system, said three members consisting of said outer sheath, said connecting member, and said sleeve, for providing leeway in the engagement of said three members for minimizing leaking of the spout.

26. A spout as in claim 19, wherein said outer sheath further is rotatable on the spout housing, and wherein said outer sheath is configured to be slidable along the spout housing only when the outer sheath is in one or more selected rotational positions.

27. A spout as in claim 19, comprising a body and a nozzle unit generally coaxially connected, wherein said nozzle unit comprises said sealing ridge and said stopper.

28. A spout as in claim 27, wherein said sleeve has at least one longitudinal projection extending toward said second end, and wherein said nozzle unit is generally hollow and receives said longitudinal projection, said nozzle unit having at least one alignment protrusion extending radially inward toward, and engaging, said longitudinal projection.

29. A spout as in claim 19, wherein the liquid-flow passageway portion comprises a proximal portion near said first end of the spout housing and a distal portion near said second end of the spout housing, wherein said distal portion is smaller in volume than said proximal portion creating a venturi effect as the liquid flows through said liquid-flow passageway portion toward the second end.

30. A spout as in claim 19, wherein said air-flow passageway is defined near said spout housing first end by a generally tubular extension out from the spout housing that is configured to extend into the liquid container farther than the first end of the spout housing so that the pressure in the generally tubular extension is less than the pressure in the liquid-flow passageway at the first end of the spout housing.

31. A spout as in claim 19, wherein said first annular seal is a portion of a bell-shaped outer surface of said sleeve.

32. A spout as in claim 19, wherein said spring is received in said interior passageway.

* * * * *